US008172597B1

(12) United States Patent
Terhune, IV

(10) Patent No.: US 8,172,597 B1
(45) Date of Patent: May 8, 2012

(54) ELECTRICAL CONNECTOR WITH SLIDING LATCH

(75) Inventor: Albert Harvey Terhune, IV, Chandler, AZ (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/113,092

(22) Filed: May 23, 2011

(51) Int. Cl.
*H01R 13/62* (2006.01)

(52) U.S. Cl. ..... 439/331; 439/73

(58) Field of Classification Search ..... 439/331, 439/330, 342, 347, 73
See application file for complete search history.

(56) References Cited

U.S. PATENT DOCUMENTS 6,485,320 B1 * 11/2002 Ma ..... 439/342
6,699,057 B2 * 3/2004 Ma ..... 439/342
6,827,587 B2 * 12/2004 Ma ..... 439/73

* cited by examiner

*Primary Examiner* — Tulsidas C Patel
*Assistant Examiner* — Travis Chambers
(74) *Attorney, Agent, or Firm* — Andrew C. Cheng; Wei Te Chung; Ming Chieh Chang

(57) ABSTRACT

An electrical connector includes a socket with a number of electrical contacts and a loading mechanism surrounding the socket. The loading mechanism includes a stiffener, a load plate mounted to one end of the stiffener and rotating from an open position to a closed position, and a sliding latch mounted to an opposite end of the stiffener. The load plate has a plate portion and a tongue extending downwardly from the plate portion at said opposite end. The sliding latch moves on the stiffener in a horizontal direction and a vertical direction to lock or unlock the load plate.

18 Claims, 6 Drawing Sheets

ELECTRICAL CONNECTOR WITH SLIDING LATCH

BACKGROUND OF THE INVENTION

1. Field of the Invention

The invention relates generally to socket connectors and particularly to a socket connector with an improved loading mechanism.

2. Description of Related Art

Competition and market demands have continued the trends toward faster, higher performance electrical systems, particularly with regard to computer systems. Along with the development of surface mount technology in the design of printed circuit boards, higher density electrical circuits, electronic packages such as chip carrying modules that are to be mounted to a circuit board, and higher density interconnect components have been developed to meet the increasing demand for higher performance electrical systems. Surface mount packaging allows for the connection of electronic packages to contact pads on circuit boards rather than with contacts or pins soldered to plated holes extending through circuit boards. Surface mount technology allows for an increased component density on a circuit board, thereby saving space on the circuit board.

Area array socket connectors have evolved, along with surface mount technology, as one high density interconnect technique for integrated circuits. One application of this technology, for example, is the land grid array (LGA) socket connector that is used with an LGA package. The LGA package is durable and is not easily damaged during the installation or removal process or by handling generally. At least some of the other integrated circuit packages, such as a pin grid array (PGA) package, have a standardized layout, or form factor, for contact leads or pins on the package. The contact leads in such packages are fragile and, unlike the LGA package, can be damaged if not handled properly.

While the LGA package is durable, known LGA sockets can be problematic. In at least some LGA sockets, when the socket is opened, the electrical contacts, sometimes referred to as contact beams, are exposed and the LGA package is loaded directly on top of the contact beams by a loading mechanism. The LGA socket is designed for loading and unloading of the package in a vertical direction, i.e. a direction normal, or perpendicular to the circuit board, and consequently the loading mechanism has a stiffener and a load plate rotatably mounted thereto. A load lever made of metal wire is also provided on the stiffener for latching the load plate at a closed position and has at least a ninety degree range of movement to lock or released the load plate. Movement of the load lever for rotation also needs to occupy the space on the printed circuit board.

An improved electrical connector that overcomes the above-mentioned problems is desired.

BRIEF SUMMARY OF THE INVENTION

An object of the present invention is to provide an electrical connector with a sliding latch.

An electrical connector comprises a socket with a plurality of electrical contacts and a loading mechanism surrounding the socket. The loading mechanism comprises a stiffener, a load plate mounted to one end of the stiffener and rotating from an open position to a closed position, and a sliding latch mounted to an opposite end of the stiffener. The load plate includes a plate portion and a tongue extending downwardly from the plate portion at said opposite end. The sliding latch moves on the stiffener in a horizontal direction and a vertical direction to lock or unlock the tongue of the load plate.

An electrical connector comprises a socket with a plurality of electrical contacts and a loading mechanism surrounding the socket. The loading mechanism comprises a stiffener with a flat portion and a pair of first sidewalls bending from opposite ends of the flat portion, a load plate mounted to one end of the stiffener and rotating from an open position to a closed position, and a sliding latch mounted to an opposite end of the stiffener. The load plate includes a plate portion and a tongue extending downwardly from the plate portion at said opposite end. The sliding latch is attached to one of the first sidewalls and slides thereon. The sliding latch is capable of sliding on the stiffener and includes a vertical plate, a retention section extending from the vertical plate and secured to one of the first sidewalls, and a press section bending from the vertical plate to lock or unlock the tongue of the load plate Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
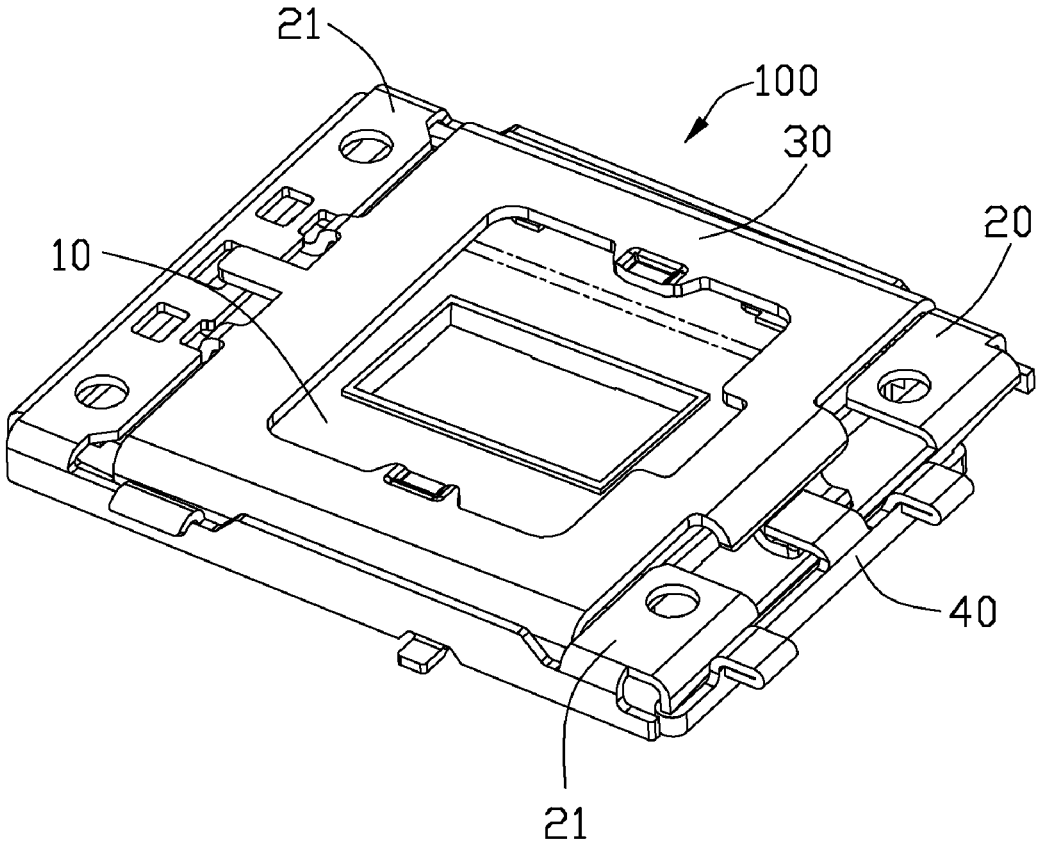
FIG. 1 is an assembled, perspective view of an electrical connector according to a preferred embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 2:
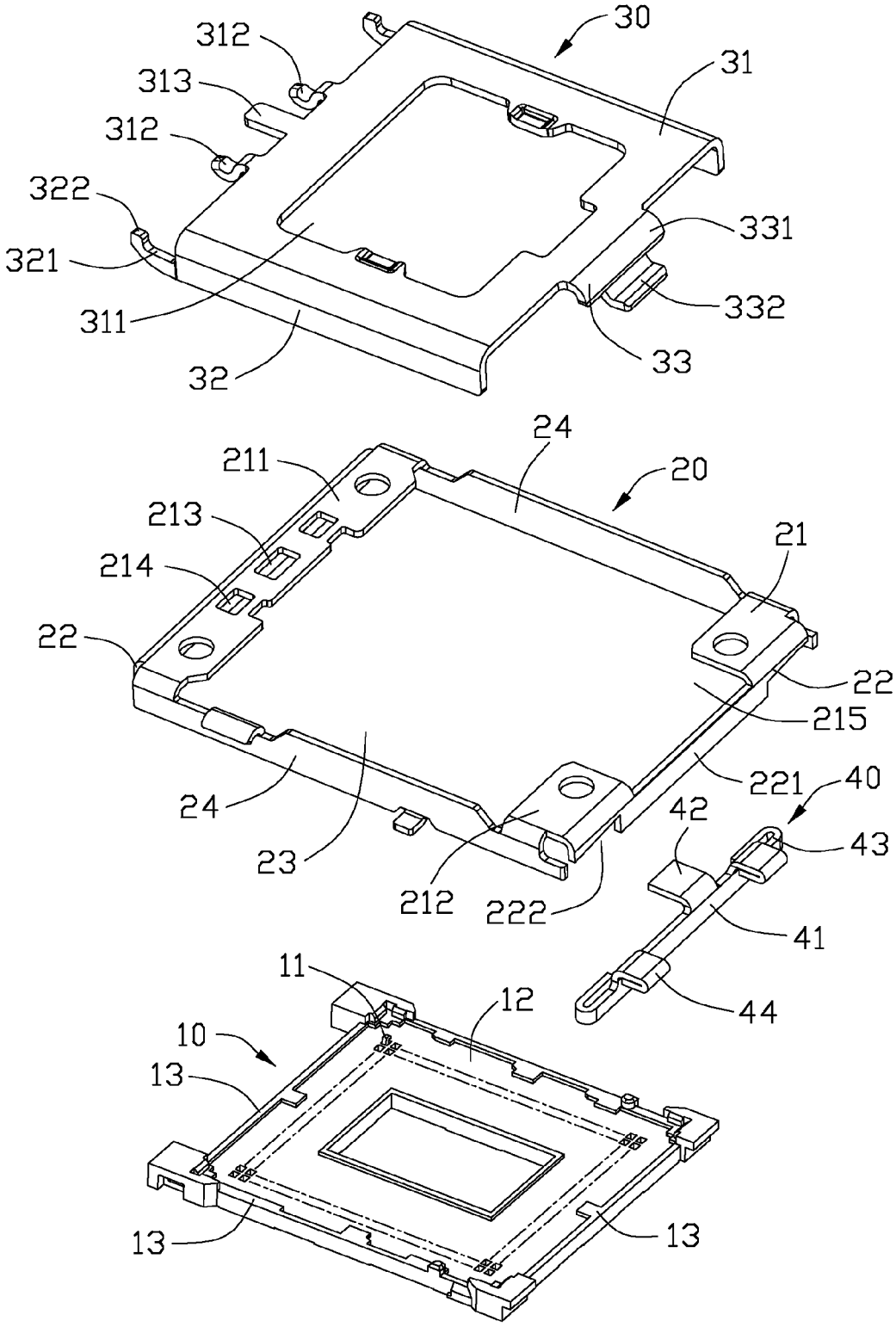
FIG. 2 is an exploded, perspective view of the electrical connector shown in FIG. 1.

FIGS. 1-2 show an example of an electrical connector 100 in accordance with one embodiment of the invention. The electrical connector 100 includes a socket 10 with a plurality of electrical contacts 11 (only one is shown) and a loading mechanism. The socket 10 is surrounded by the loading mechanism and defines a conductive region 12 formed by a plurality of sidewalls 13 thereof.

Figure 3:
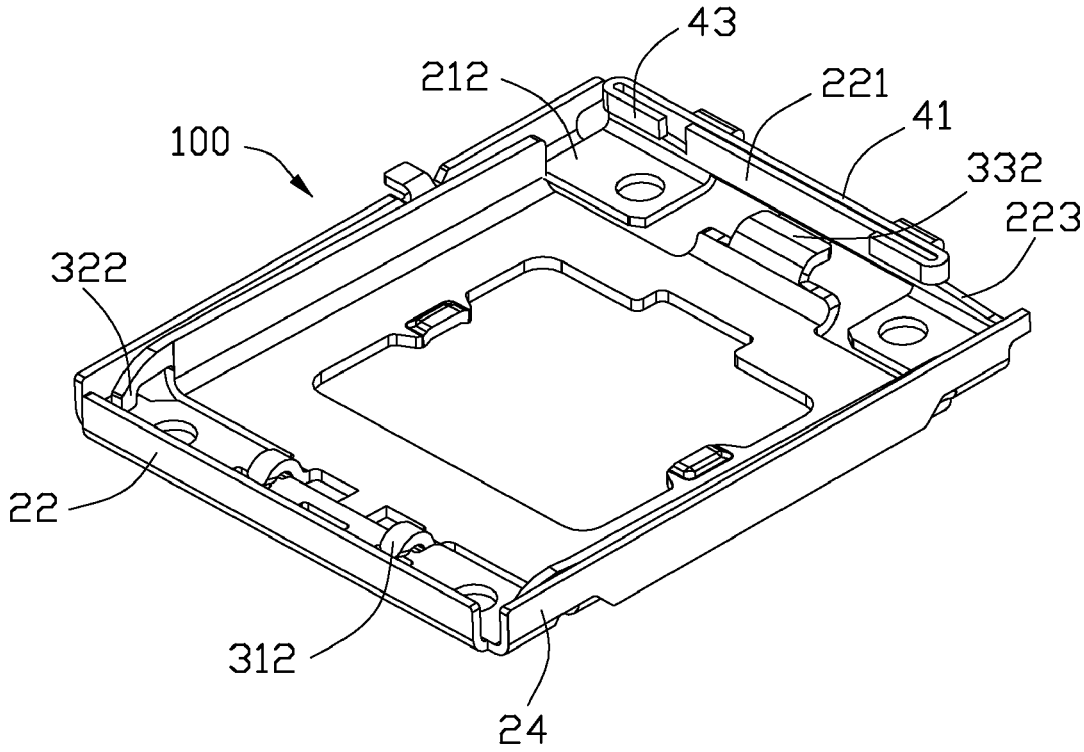
FIG. 3 is a perspective view of the loading mechanism shown in FIG. 1.

Please referring to FIGS. 2-3, the loading mechanism comprises a stiffener 20, a load plate 30 mounted to one end of the stiffener 20, and a sliding latch 40 mounted to an opposite end of the stiffener 20. The stiffener 20 has a flat portion 21 and a pair of first sidewalls 22 bending from opposite ends of the flat portion 21. An opening 23 is defined on the flat portion 21 so as to divide the flat portion 21 into two parts, named a first side plate 211 and a second side plate 222 respectively. The first side plate 211 and the second side plate 212 are connected with each other by a pair of second sidewalls 24 which are perpendicular to the pair of first sidewalls 22.

The first side plate 211 defines a first recess 212 at middle thereof and a pair of second recesses 213 at opposed sides of the first recess 212. One of the first sidewall 22 bending from the second side plate 212 includes a main section 221 and a pair of notches 222 at opposite sides of the main section 221. Each of the notches 222 has a top edge 223 which defines a slant angle with respect to a horizontal plane.

The load plate 30 includes a plate portion 31 with an opening 311 and a pair of sidewalls 32 perpendicular to the plate portion 31. A pair of hooks 312 extends from one end of the plate portion 31 for coupling to the second recesses 214 of the stiffener 20 so that the load plate 30 rotates on the stiffener 20 between an open position and a closed position. The plate portion 31 includes a tab 313 located between the pair of hooks 312 and received in the first recess 213 during rotation of the load plate 30. A pair of stopper 321 projects from the sidewalls 32 and each has a hook 322 for resisting the first side plate 211 at the open position.

A tongue 33 extends from the other end of the plate portion 31 and comprises a first bending section 331 extending downwardly from the plate portion 31 and a second bending section 332 bending and protruding laterally from the first bending section 331. A notch 215 is provided on the second side plate 212 for receiving the tongue 33.

The sliding latch 40 is coupled to the stiffener 20 and capable of sliding in a vertical plane. The sliding latch 40 includes a vertical plate 41, a press section 42 bending from the vertical plate 41, a pair of retention sections 43 extending from opposite sides of the vertical plate 41, and a pair of operating sections 44 at opposite sides of the press section 42. The press section 42 and the pair of operating sections 44 are located at a top end of sliding latch 40 and bent in opposite directions from the vertical plate 41. Each of the retention sections 43 has a pair of pieces parallel to each other for wrapping the main section 221 of the first sidewall 22.

Figure 4:
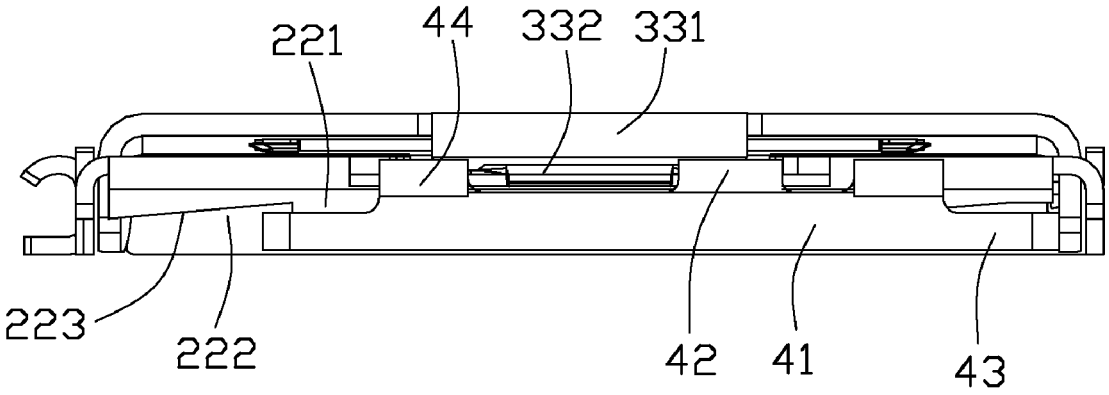
FIG. 4 is a side view of the loading mechanism showing the sliding latch is located at an open position.
Figure 5:
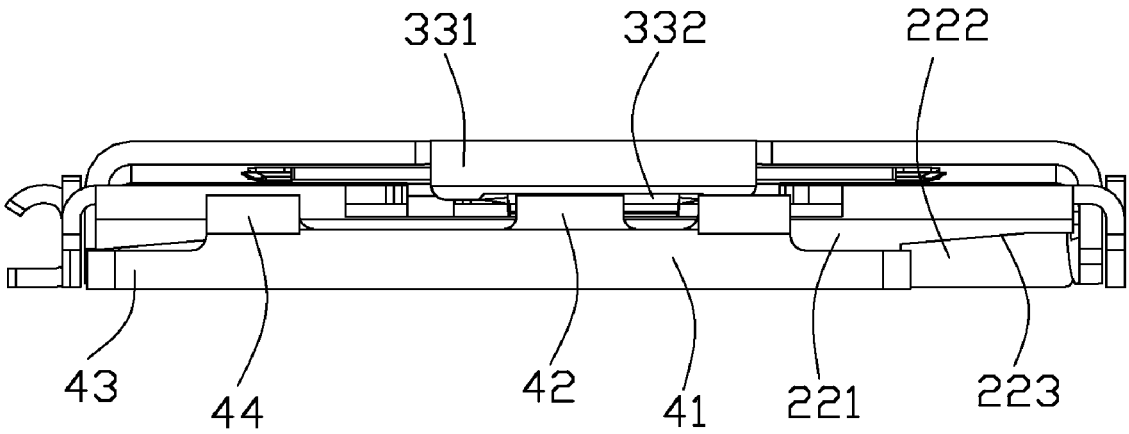
FIG. 5 is similar to FIG. 4 while the sliding latch slides to a closed position.
Figure 6:
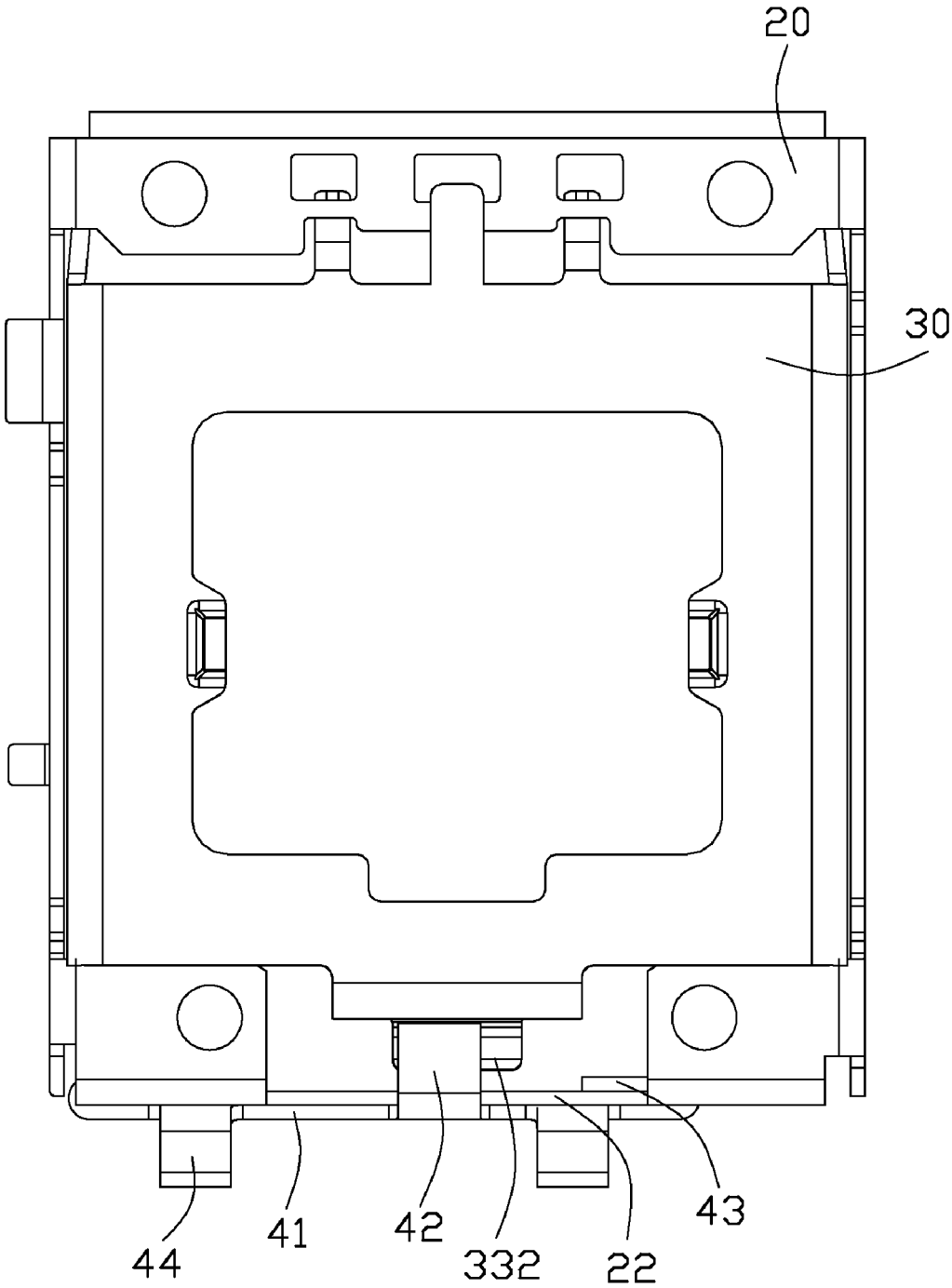
FIG. 6 is a top view of the loading mechanism shown in FIG. 5.

Please referring to FIGS. 1 and 3, the vertical plate 41 leans against the main section 221 of the first sidewall 22. One of the pair of retention sections 43 clips the main section 221 and is located under the flat portion 21 of the stiffener 20. The press section 42 passes through the first sidewall 22 and hangs the sliding latch 40 on the first sidewall 22. FIG. 4 illustrates the sliding latch 40 is located at a first position so that the load plate 30 can rotate to the open position whereby an integrated circuit package (not shown) can be disposed on the socket 10. Then, the load plate 30 can be closed. The sliding latch 40 moves along the main section 221 to a second position until the second bending section 332 is loaded by the pressed section 42 thereby secure the load plate 30 on the stiffener 20 at the closed position as shown in FIGS. 5-6.

Please be noted, the pair of retention sections 43 are stopped by the opposite sides of the first sidewalls 22 during sliding. In addition, since the top edges 223 incline downwardly from right to left which causes the sliding latch 40 not only has a horizontal movement but also has a vertical movement on the stiffener 20. The horizontal movement of the sliding latch 40 leads the press section 42 to slide on the second bending section 332 and the vertical movement of the sliding latch 40 causes the press section 42 applies a downward force to the second bending section 332 whereby locks the load plate 30 on the stiffener 20 at the closed position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector, comprising:

a socket with a plurality of electrical contacts; and a loading mechanism surrounding the socket and comprising a stiffener, a load plate mounted to one end of the stiffener and rotating from an open position to a closed position, and a sliding latch mounted to an opposite end of the stiffener, the load plate including a plate portion and a tongue extending downwardly from the plate portion at said opposite end, the sliding latch moving on the stiffener in both a horizontal direction and a vertical direction to lock or unlock the tongue of the load plate;

wherein the stiffener has a flat portion and a pair of first sidewalls bending from opposite ends of the flat portion, and the sliding latch is attached to one of the first sidewalls; and wherein the pair of first sidewalls bending downwardly from the flat portion and the flat portion defines a notch for receiving the sliding latch.

2. The electrical connector as claimed in claim 1, wherein said one of the first sidewall defines a pair of notches at opposite sides thereof, and each of the notches has a slant top edge to guide the movement of the sliding latch.

3. The electrical connector as claimed in claim 1, wherein the flat portion defines a first recess and a pair of second recesses at said one end, and the load plate includes a pair of hooks coupled to the second recesses and a tab received in the first recess.

4. The electrical connector as claimed in claim 1, wherein the flat portion defines an opening which divides the flat portion into a first side plate and a second side plate, and wherein the first side plate and the second side plate are connected with each other by a pair of second sidewalls perpendicular thereto.

5. The electrical connector as claimed in claim 1, wherein the sliding latch includes a vertical plate leaning against said one of the first sidewalls, a press section bending from the vertical plate and pressing the tongue, and a pair of retention sections extending from the vertical plate to secure the sliding latch.

6. The electrical connector as claimed in claim 5, wherein the press section hangs the sliding latch on said one of the first sidewalls and the pair of retention sections wraps said one of the first sidewalls and is located under the flat portion of the stiffener, and at least one operating sections is provided on the vertical plate and extends away from the press section.

7. An electrical connector, comprising:

a socket with a plurality of electrical contacts; and a loading mechanism surrounding the socket and comprising a stiffener with a flat portion and a pair of first sidewalls bending from opposite ends of the flat portion, a load plate mounted to one end of the stiffener and rotating from an open position to a closed position, and a sliding latch mounted to an opposite end of the stiffener, the load plate including a plate portion and a tongue extending downwardly from the plate portion at said opposite end, the sliding latch capable of sliding on the stiffener and including a vertical plate, a retention section extending from the vertical plate and secured to one of the first sidewalls, and a press section bending from the vertical plate to lock or unlock the tongue of the load plate.

8. The electrical connector as claimed in claim 7, wherein the press section hangs the sliding latch on said one of the first sidewalls and the pair of retention sections is under the flat portion of the stiffener, and wherein at least one operating sections is provided on the vertical plate and extends away from the press section.

9. The electrical connector as claimed in claim 7, wherein the pair of first sidewalls bends downwardly from the flat portion and the flat portion defines a notch for receiving the sliding latch.

10. The electrical connector as claimed in claim 7, wherein the flat portion defines a first recess and a pair of second recesses at said one end, and the load plate includes a pair of hooks coupled to the second recesses and a tab received in the first recess.

11. The electrical connector as claimed in claim 7, wherein the flat portion defines an opening which divides the flat portion into a first side plate and a second side plate, and wherein the first side plate and the second side plate are connected with each other by a pair of second sidewalls perpendicular thereto.

12. The electrical connector as claimed in claim 7, wherein said one of the first sidewalls defines a pair of notches at opposite sides thereof, and each of the notches has a slant top edge to guide the sliding of the sliding latch in a vertical plane.

13. The electrical connector as claimed in claim 12, wherein the pair of retention sections warps said one of the first sidewalls and is stopped by the opposite sides of said one of the first sidewalls during sliding.

14. An electrical connector comprising:

an insulative housing defining opposite first and second ends and an upward facing receiving cavity between said first and second ends;

a plurality of contacts disposed in the housing;

a metallic frame structure located around the housing;

a load plate pivotally mounted to the frame structure around the first end of the housing with defining a pivot axis thereof, and further defining a bending section;

a sliding latch attached to the frame structure around the second end of the housing and moveable along a transverse direction parallel to said pivot axis; wherein a guiding structure is formed between the sliding latch and the frame structure to have the sliding latch to move downwardly when said sliding plate moves from an open position to a locking position in the transverse direction so as to lock the bending section.

15. The electrical connector as claimed in claim 14, wherein the frame structure includes an end wall with a main section, and the slide latch wraps said main section for securing the sliding latch to the frame structure.

16. The electrical connector as claimed in claim 14, wherein the guiding structure is a slanted edge formed on the frame structure to downwardly confront the sliding latch.

17. The electrical connector as claimed in claim 14, wherein the sliding latch defines a press section extending in a direction defined from the second end to the first end to not only hold the sliding latch upon the main section of the end wall but also downwardly press the bending section when said sliding latch is moved to the locking position.

18. The electrical connector as claimed in claim 17, wherein the sliding latch defines an operation section extending in another direction opposite to said direction.

* * * * *